US005108340A

United States Patent [19]

Farrow

[11] Patent Number: 5,108,340

[45] Date of Patent: Apr. 28, 1992

[54] MUSICAL AND LIGHTED ENTERTAINMENT AND EXERCISE DEVICE

[76] Inventor: Madelyn T. Farrow, 19617 Cleveland Rd., South Bend, Ind. 46637

[21] Appl. No.: 699,720

[22] Filed: May 14, 1991

[51] Int. Cl.[5] ..... A63H 1/24; A63H 33/22; A63H 1/32; A63H 33/00

[52] U.S. Cl. ..... 446/242; 446/254; 446/219; 446/28; 446/485

[58] Field of Search ..... 446/242, 236, 243, 244, 446/254, 265, 28, 219, 297, 302, 303, 450, 451, 484, 485

[56] References Cited

U.S. PATENT DOCUMENTS

| | | | |
|---|---|---|---|
| 989,944 | 4/1911 | Bramson | 446/242 X |
| 4,006,556 | 2/1977 | Williams | 446/242 |
| 4,085,541 | 4/1978 | Mapp | 446/450 |
| 4,237,647 | 12/1980 | Shaw | 446/303 |
| 4,327,518 | 5/1982 | Knauff | 446/242 |
| 4,451,911 | 5/1984 | Klose et al. | 446/303 X |
| 4,508,511 | 4/1985 | McQueen | 446/485 X |
| 4,563,160 | 1/1986 | Lee | 446/242 X |
| 4,568,303 | 2/1986 | Brown | 446/242 |
| 4,915,666 | 4/1990 | Maleyko | 446/242 |

FOREIGN PATENT DOCUMENTS

| | | | |
|---|---|---|---|
| 1211877 | 3/1960 | France | 446/28 |

*Primary Examiner*—Robert A. Hafer
*Assistant Examiner*—D. Neal Muir
*Attorney, Agent, or Firm*—Thomas J. Dodd

[57] ABSTRACT

An improvement in an entertainment and exercise device commonly referred to as a Hula Hoop, such improvement comprising the insertion within the tubular form of a variety of sensory appealing features, such as lighting and music.

5 Claims, 1 Drawing Sheet

MUSICAL AND LIGHTED ENTERTAINMENT AND EXERCISE DEVICE

SUMMARY OF THE INVENTION

This invention relates to an entertainment and exercise device and more particularly that which is commonly referred to as a "Hula Hoop."

Although the hoop has never regained its initial popularity, it has maintained a degree of popularity as an entertainment device and has been recognized as making an appreciable beneficial contribution as an exercise device.

A variety of materials and material colors have been utilized to date, but there has never been a significant modification of the basic initial concept.

With the advent and miniaturization of integrated circuits, lighting devices and power sources therefor, it is now possible to insert such devices inside the tubular cross-section of the hoop.

It is the principal object of this invention to provide an improvement in the hoop by the insertion of lighting means and musical means, individually or in combination with each other.

Other objects of this invention will become apparent upon a reading of the following description.

BRIEF DESCRIPTION OF THE DRAWING

A preferred embodiment has been depicted for illustrative purposes wherein.

DESCRIPTION OF THE PREFERRED EMBODIMENT

Figure 1:
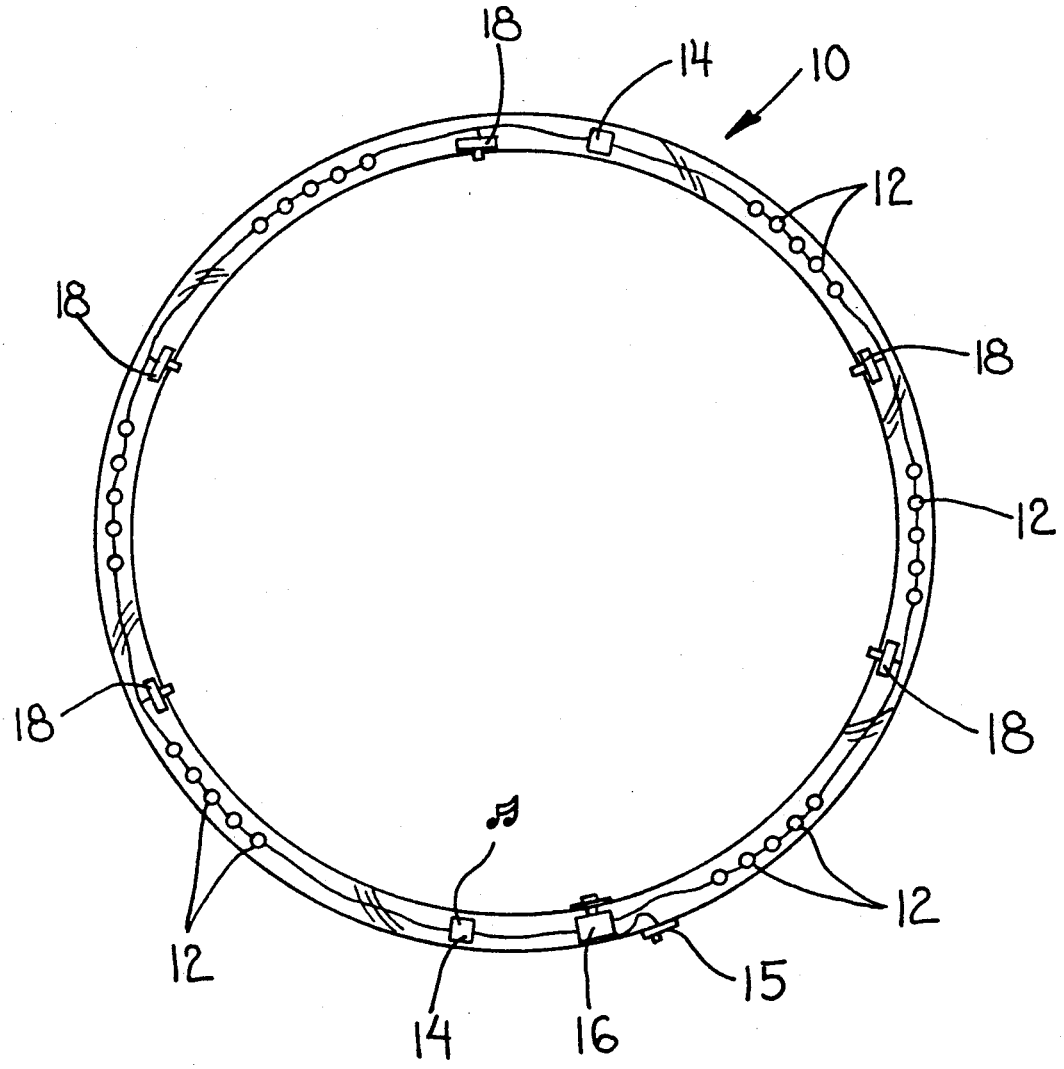
FIG. 1 is a plan view of the hoop with portions cut away, both lighting and musical features alternatively and intermittently spaced within and about a hoop.

The preferred embodiment herein described is not intended to be exhaustive or to limit the invention to the precise form disclosed. It is chosen and described to explain the principles of this invention and its application and practical use to enable others skilled in the art to utilize the invention.

A hollow plastic hoop 10 of translucent material has wiring anchored within to link a power source such as batteries 16 and other internal elements. There are a plurality of lights 12 arranged in strips of five lights per strip and are anchored within the tube to be visible, when lighted, from the outside of the tube.

There is a multi-purpose switch 15 which switches the batteries 16 to either the light bulbs, sounder 14 and speaker or all together. The sounder is an integrated circuit, which is a commercially available circuit with one or a plurality of tone sequences, and can be energized to output through the speakers (not shown) to play a tune or tunes during use. Switch 15 also has a position which activates inner pressure activated switches 18 so that the switches may be activated by contact with a person's waist. The switches 18 activate an adjacent bank of lights. The lights may light sequentially, as is common with "running lights" or as a group. Switch 15 also has a position where the lights all blink at once at a preset interval and the sounder 14 is continuously activated with the lights. There is also a position where the sounder 14 is energized along with the inner pressure switches.

The invention envisions a loop 10 with power source 16, a main switch 15, a sounding system 14, and a lighting system 12. These are all interconnected by a wiring system, the wires may be embedded in the material of the hoop. The pressure switches 18, which are part of the lighting system, are flush mounted on the inner periphery of the hoop so as to not catch on the clothes of a user. The system envisions use where only the sound system 14 is activated, where the lights 12 are activated by the individual pressure switches 18, where the lights 12 are activated to blink together, and where the lights 12 and sounder system 14 are both activated. It is also envisioned that the main switch 15 may be replaced with an acceleration switch (not shown) which activates the sounder 14 and light system 12 in response to normal movement around a user, where when motion stops the circuits are deactivated.

I claim:

1. A hula hoop toy comprising a tube formed of translucent plastic, an electrical system enclosed within said tube, said electrical system including a plurality of interconnected lights and a sounding member, power means enclosed in said tube for delivering electric power to said system, a plurality of pressure activated switches positioned along an inner perimeter of said tube, said switches constituting means for activating said electrical system when pressed, a second switch located along an outer perimeter of said tube, said second switch connected to said electrical system and having multiple on positions for selectively actuating one of a plurality of combinations of said lights and said sounding member upon actuation of said first mentioned switches.

2. The hula hoop of claim 1 wherein said second switch includes a motion sensor to activate one of said sounding system and said pressure switches upon tube rotation.

3. The hula hoop toy of claim 1 wherein said lights are arranged in spaced groups of several individual lights.

4. The hula hoop toy of claim 3 wherein said second switch has a position to selectively activate one or more of said spaced groups of individual lights.

5. The hula hoop toy of claim 1 wherein said tube is formed of transparent plastic.

* * * * *